United States Patent [19]

Forjot

[11] 4,083,071

[45] Apr. 11, 1978

[54] SWIM FLIPPERS

[76] Inventor: Roland Forjot, 117 Avenue de Rimiez, 06100 Nice, France

[21] Appl. No.: 759,861

[22] Filed: Jan. 17, 1977

[30] Foreign Application Priority Data

Jan. 20, 1976 France ..... 76 02214

[51] Int. Cl.[2] ..... A63B 31/10

[52] U.S. Cl. ..... 9/309

[58] Field of Search ..... 9/304, 305, 308, 309; 115/28 R

[56] References Cited

U.S. PATENT DOCUMENTS

| | | | |
|---|---|---|---|
| 3,055,025 | 9/1962 | Ferraro et al. | 9/309 |
| 3,422,470 | 1/1969 | Mares | 9/309 |
| 3,649,979 | 3/1972 | MacNiel | 9/309 |
| 3,913,158 | 10/1975 | Vilarrubis | 9/309 |

FOREIGN PATENT DOCUMENTS

| | | | |
|---|---|---|---|
| 16,787 | 12/1912 | Denmark | 115/28 R |
| 2,269,980 | 12/1975 | France | 9/309 |

*Primary Examiner*—Galen L. Barefoot
*Assistant Examiner*—Edward R. Kazenske

[57] ABSTRACT

Swim flippers having a shoe portion and a fin portion. The fin portion is formed with a continuous through channel for the flow of water, an exit at its forward end, an inlet opening at the trailing end in each of the upper and lower surfaces. A flap, responsive to the movement of the flipper in water is provided between the inlets for directing the flow of water into one of the inlets while simultaneously closing the other of the inlets.

7 Claims, 4 Drawing Figures

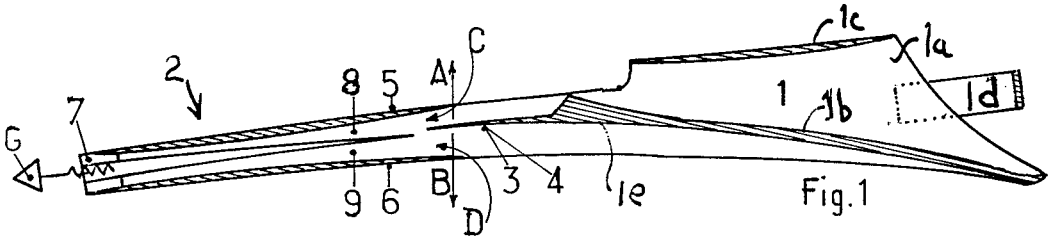
Fig. 1
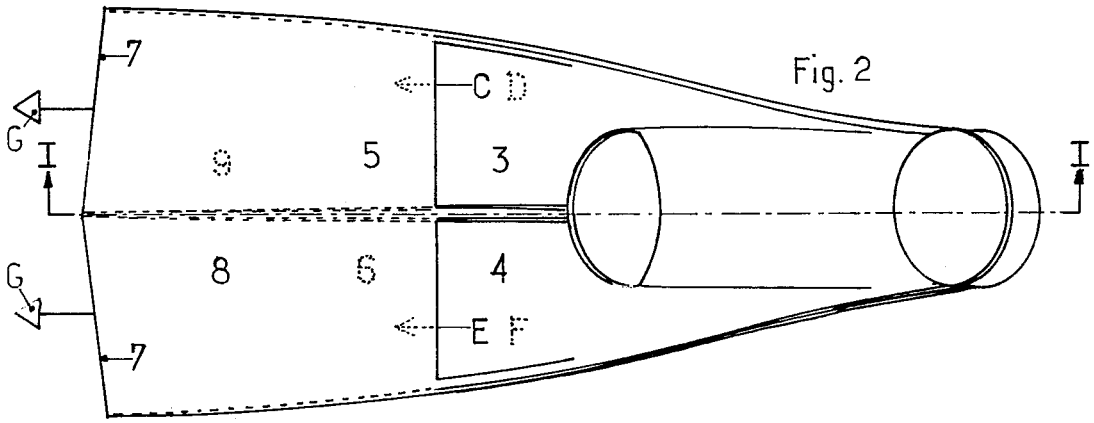
Fig. 2
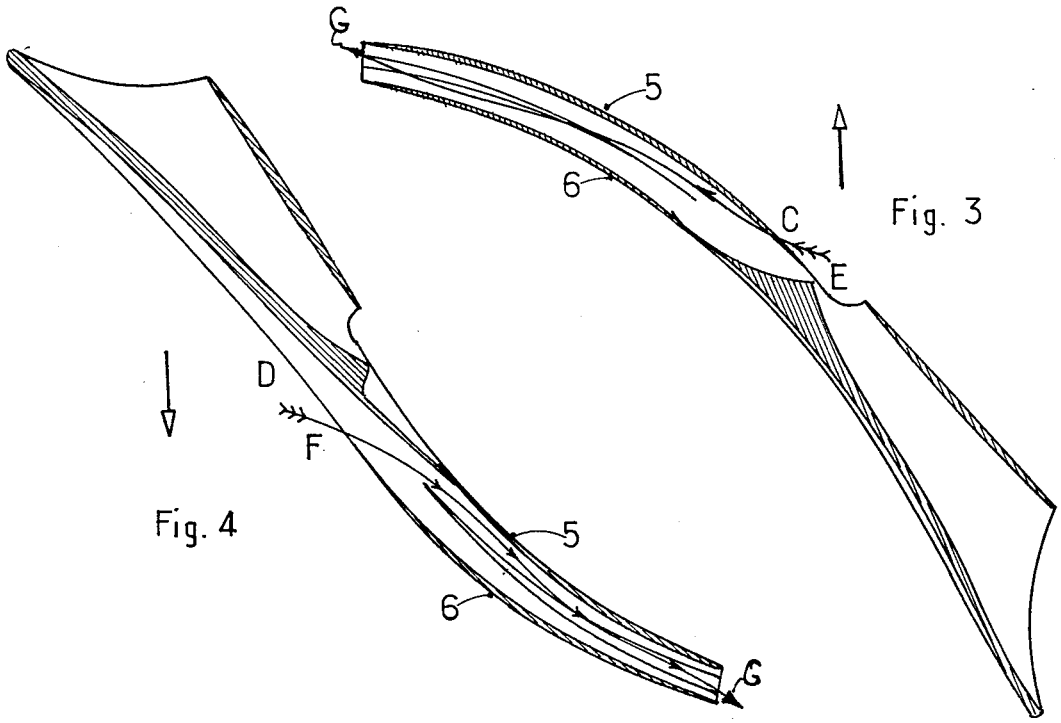
Fig. 3
Fig. 4

SWIM FLIPPERS

BACKGROUND OF THE INVENTION

The present invention relates to swimming apparatus, in particular, to flippers to be worn on the feet of the swimmer to enhance mobility.

Whenever man has endeavored to develop in an environment in which he was alien, he had to look for inspiration and teaching to those organs which nature gave to the creatures native to that environment, which organs man himself lacked. For example, the ailerons of an airplane are related to the wings of the birds, and the flippers which divers and swimmers employ to supplement the fin-like structure of hands and feet are similar to the webbing and the fins of fish and batrachians (frogs, toads and the like).

It is evident that it is the movement of the water over the surface of a fin that creates the push which makes the swimmer (fish or man) proceed with increased mobility. However, this same surface creates friction, turbulence and cavitation within the water producing a diminished result in the applied force of the swimmer. Because the natural fins of man (hands or feet) are relatively small and ineffective, man has begun to utilize supplemental flippers which he fastens to his feet which enable these lower limbs to better move and flex. In general, most flippers used are formed of a single membrane or sheet having an upper and lower surface only. Recently, however, some flippers have been made utilizing a second membrane, so that a kind of a flat, hollow compartment is formed between the two membranes in the largest part of the flipper. This arrangement permits the flipper to hold back water on one side, while permitting its replacement on the other side. This flow of water resembles the flowing of water which one observes within the locomotor tubes of certain cephalopodes and molluscs, particularly the cuttlefish. As a result, a slight improvement in the effect of the applied force of the fin is observed. However, such construction does not enable the expansion or flow of water outwardly of the fins in both the downward and in the upward stroke of the swimmer, similar to that experienced by the batrachians.

One may liken this latter effect to that experienced by a bicycle rider while peddling. The propelling force of the bicycle is limited when the rider only pushes downwardly on the pedals alternately with his feet. However, by utilizing the chain drive which maintains the pedal in constant motion, the efforts of raising the opposing feet once the pedals have passed a dead center is lessened and an increased force efficiency is obtained. This is easily seen merely by fastening each foot to the pedal near the metatarsus. This method of pedalling the bicycle is similar to the push-pull work used to operate a crank.

With the foregoing in mind, the object of the present invention is to improve the construction of the flippers, used by swimmers, so that they are more effective to the swimmer in both the upward and downward strokes.

It is a further object of the present invention to provide an improved flipper which enables the flow of water through it, without creating turbulence, or cavitation, in the water.

It is another object of the present invention to provide a flipper in which greater force efficiency and a synergistic effect is obtained in both the downward and upward strokes.

The foregoing objects, together with other advantages and objects, will be apparent from the following disclosure of the present invention.

SUMMARY OF THE INVENTION

According to the present invention, swim flippers are provided having a shoe portion and a fin portion. The fin portion is formed with a continuous through channel for the flow of water, an exit at the forward end of said fin, and an inlet opening at the trailing end of each of its upper and lower surfaces. Means responsive to the movement of the flipper in water is disposed between the inlets for directing the flow of water into one of the inlets while simultaneously closing the other of the inlets.

The fin portion is formed of an upper wall and a lower wall spaced from each other and joined along their longitudinal edges to form a hollow chamber open at the forward end and which is provided with an inlet opening in the top wall and a second inlet opening in the bottom wall. At least one flexible shutter is located within the chamber between the two inlets. The shutter is capable of oscillating, i.e., flexing, alternately into engagement with the upper wall or the lower wall respectively, so that the flow of water through the chamber occurs respectively from the upper surface and the lower surface of the fin on stroking of the limb.

In particular, the flipper of the present invention comprises a shoe portion adapted to be secured to the foot of the swimmer from which extends the double wall fin described above. The outlet opening is along the frontal edge or end of the fin, while each inlet is formed between the trailing edges of the respective upper and lower walls as the front edge of the shoe portion. The shutter comprises a wedge shaped or tapering flap, connected at its thicker base to the front end of the shoe portion, so as to freely oscillate about an axis transverse to the foot. The thinner front end of the flap extends into the chamber between the upper and lower walls, so that it can come into contact with each (alternatingly) on the movement of the foot.

Full details of the present invention are set forth in the following description, and will be seen in the accompanying drawings.

BRIEF DESCRIPTION OF THE DRAWINGS

In the drawings:

FIG. 1 is a vertical cross-sectional view of the flipper formed in accordance with the present invention taken along the line I - I of FIG. 2;

FIG. 2 is a plan view of the flipper shown in FIG. 1;

FIG. 3 is a view of the flipper in use during a pushing stroke; and

FIG. 4 is a similar view to that of FIG. 3 showing the flipper in the relaxed or return stroke.

DESCRIPTION OF THE INVENTION

As seen in FIGS. 1 and 2, the flipper of the present invention is unitarily formed of rubber, synthetic rubber, plastic or similar flexible material customarily used in the formation of such devices. The flipper comprises a shoe portion generally depicted by the numeral 1 and a generally planar fin portion generally depicted by the numeral 2 having a hollow interior. The shoe portion 1 is shaped to receive the foot of the swimmer and is provided with side quarters 1*a*, sole 1*b*, an instep portion 1*c*, and an open heel through which a sling 1*d* is attached. The sole portion extends forwardly in an elongated toe 1*e* to which a pair of flexible shutters 3 and 4 are fixed. The shutters 3 and 4 are extending flaps of tapering wedge-shape cross section, the thicker base being connected at the forward end of the sole 1*e*, the leading end extending normally centrally into the fin portion 2. The shutters 3 and 4 oscillate in the direction indicated by the arrows A and B perpendicular to the general plane of the fin 2.

The fin portion 2 is formed of an upper membraneous wall 5 and a lower membraneous wall 6 joined along their side longitudinal edges. The side longitudinal edges extend rearwardly being connected to the appropriate side portions of the shoe part 1, so that a unitary construction between the fin portion 2 and the shoe portion 1 is obtained, leaving an opening between the trailing edge of the upper wall 5 and the forward edge of the instep portion 1*c*, as well as an opening between the trailing edge of the lower wall portion 6 and the forward edge of the sole portion 1*e*. Connecting members such as straps can be employed to connect the trailing edges of the upper and lower walls to the shoe provided the inlet openings are maintained. Preferably, the side portions joining the upper and lower walls of the fins to the shoe part extend rearwardly to the heel of the shoe part, so that a flexible movement between the sole 1*e* and the lower wall 6 is also obtained, as will be seen from the motion diagrams shown in FIGS. 3 and 4. The upper and lower walls 5 and 6 are spaced from each other, so that a continuous channel or chamber is formed leading to the forward end 7 of the fin.

To strengthen the upper and lower walls 5 and 6, longitudinal ribs 8 and 9 respectively are provided extending along the center line. The thickness and rigidity of the ribs 8 and 9 are chosen to conform to the strength desired and the flexibility of the membraneous walls of the fin, to provide a desired operational characteristic. The ribs pass between the flaps 3 and 4 and as a result provide two pairs of openings in the fin portion, the openings C and D in the upper and lower walls respectively on the right side of the ribs, as seen in the figures, and corresponding openings E and F on the left side of the fin.

The flipper as described can be molded and cast or otherwise formed in an integral structure, or formed first in parts, which parts are then welded together to form a unitary flipper. The molding, casting or formation of the flipper can proceed in conventional manner utilizing those materials known in the ordinary construction of flippers. The exterior design, exact dimensions, and several other variations can be selected by those skilled in the art, within the knowledge of the present art.

In use, the flipper of the present invention provides effective means for maintaining full control of fluid in or about the flipper, and greatly increasing its efficiency. The increased efficiency is obtained, no matter what orientation the flipper takes in the water. For example, in FIG. 3, the flipper is shown in an upwards or pushing direction indicated by the enlarged arrow next to the drawing designation. Being pushed against the flow of water, in flipper takes an arcuate path or concave curvature of the upper and the lower walls of the fin. As a result, water is caused to flow into the openings C and E above the flaps 3 and 4 which are caused to oscillate and move downwardly, so that their forward ends become engaged to the trailing end of the lower member in the wall 6. These flaps thus close the openings D and F between the trailing end of the lower wall 6 and the leading end 1*e* of the sole portion forming thus a continuous lower wall comprising the lower wall member of the fin 6 and the sole of the foot portion. Water, rushing contrary to the movement of the fin, i.e., contrary to the enlarged arrow, moves into the openings C and E and through the channel between the upper and lower walls 6 of the fin and outwardly of the frontal end 7 of the interior chambers in the path indicated by the arrows G. On the other hand, in the relaxation or downward movement of the flipper, as illustrated in FIG. 4, the upper and lower walls 5 and 6 become flexed in a convex curvature and the oscillating flaps 3 and 4 are raised, so that their leading ends are in engagement with the trailing edge of the upper wall 5, thereby forming a substantially continuous upper surface of the instep and upper wall 5 connected by the fins 3 and 4. Water then rushes into the openings D and F passing through the channel between the upper and lower walls 6 outwardly of the front end 7 in the path marked G. Again, the continuous surface on the upper wall of the flipper and flow of water directly through the fin increases efficiency, reducing turbulence and cavitation.

It will also be observed that a particularly advantageous effect is obtained by providing a relative movement between the sole of the foot portion and the upper and lower walls of the fins, particularly when the flaps are extensions of the toe portion of sole. Movement of the swimmer's foot and even of the toes is thus capable of exerting a positive directional movement to the flap, insuring opening of one inlet while simultaneously closing the other.

In the embodiment shown, central ribs 8 and 9 are illustrated for strengthening rigidity of the membraneous walls 5 and 6. It will be apparent that the use of such ribs may not be necessary when the walls are sufficiently self-rigid and/or provided with other reinforcing or strengthening means, as, for example, on the exterior surfaces. Alternatively, the ribs 8 and 9 can stop short of the leading edges of of the oscillating flaps 3 and 4. In either event, the flaps 3 and 4 can be combined into a single flap and the two pairs of openings C and E and D and F combined into only two single openings. At least one flap is thus necessary for the operation of the present invention.

Various other modifications and changes have been suggested in this disclosure, others will be obvious to those skilled in the present art. Accordingly, the applicant intends that the present disclosure be taken as illustrative only and not as limiting of the present invention.

What is claimed is:

1. Swim flippers comprising a shoe portion and a fin portion, said fin portion having upper and lower surfaces and a continuous through channel for the flow of water therethrough, a water discharge exit at the forward end of said fin portion, a water inlet opening at the trailing end of each of the upper and lower surfaces of said fin portion communicating with said through channel, and flap means integral with said shoe portion and extending forwardly therefrom, said flap means being pivotably mounted interiorly between said shoe portion and said fin portion and into said through channel between said inlet openings so as to be oscillatable responsive to the movement of said flipper in water for alternately directing the flow of water into one of said inlets while simultaneously closing the other of said inlets.

2. The flippers according to claim 1, wherein said flap means is formed of flexible elastic material.

3. The flippers according to claim 1, wherein said flap means is secured along one edge and is free along the remaining edges.

4. The flippers according to claim 1, wherein each of the upper and lower surfaces of said fin portion is formed with at least two inlet openings arranged in corresponding pairs and said flap means is disposed between each pair.

5. The flippers according to claim 4, including rib means for imparting rigidity integrally formed in said upper and lower surfaces between adjacent inlet openings and extending longitudinally along said fin portion.

6. The swimming flippers according to claim 1, wherein said shoe portion comprises a sole member, side quarters and an instep member, and said fin portion comprises an upper wall defining said upper surface and a lower wall defining said lower surface spaced therefrom, the longitudinal edges of said upper and lower walls being joined together thereby forming said through channel, the trailing edge of the upper wall and the trailing edge of said lower wall being at least in part spaced from the instep member and sole member respectively to form the inlet openings, said flap means being secured to the leading edge of said sole member and extending freely into said channel between the inlet openings.

7. The flippers according to claim 6, wherein said longitudinal edges extending rearwardly for juncture with said shoe portion, to provide relative movement between said shoe and fin portions.

* * * * *